US008013751B2

(12) United States Patent
Siber et al.

(10) Patent No.: US 8,013,751 B2
(45) Date of Patent: Sep. 6, 2011

(54) FIRE ALARM WITH A TRANSMITTER SPACED FROM A RECEIVER THROUGH A COLORED SHEET

(75) Inventors: Bernd Siber, Glonn (DE); Andreas Hensel, Egmating (DE); Stefan Sittenauer, Munich (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 905 days.

(21) Appl. No.: 10/556,989

(22) PCT Filed: Sep. 27, 2004

(86) PCT No.: PCT/EP2004/052328

§ 371 (c)(1),
(2), (4) Date: Nov. 16, 2005

(87) PCT Pub. No.: WO2005/051053

PCT Pub. Date: Jun. 2, 2005

(65) Prior Publication Data

US 2007/0040695 A1 Feb. 22, 2007

(30) Foreign Application Priority Data

Nov. 18, 2003 (DE) ..... 103 53 836

(51) Int. Cl.
*G08B 17/00* (2006.01)

(52) U.S. Cl. ..... 340/628; 340/693.11; 52/27; 52/39

(58) Field of Classification Search ..... 52/27, 39; 340/628, 693.9, 693.11; 174/61, 565, 559
See application file for complete search history.

(56) References Cited

U.S. PATENT DOCUMENTS

| | | | | |
|---|---|---|---|---|
| 4,166,960 | A * | 9/1979 | Meili | 250/574 |
| 4,167,688 | A * | 9/1979 | Burek et al. | 361/191 |
| 4,529,976 | A * | 7/1985 | Jameson et al. | 340/628 |
| 4,642,471 | A * | 2/1987 | Guttinger et al. | 250/574 |
| 4,758,827 | A * | 7/1988 | Powers | 340/693.9 |
| 5,333,418 | A | 8/1994 | Chambers | |
| 5,497,144 | A | 3/1996 | Schaeppi et al. | |
| 6,057,778 | A * | 5/2000 | Davidson | 340/693.9 |
| 6,300,876 | B1 * | 10/2001 | Sakurai et al. | 340/628 |
| 6,828,913 | B2 * | 12/2004 | Oppelt et al. | 340/628 |
| 7,170,417 | B2 * | 1/2007 | Gamble | 340/693.11 |

FOREIGN PATENT DOCUMENTS

| | | |
|---|---|---|
| DE | 101 18 913 A1 | 11/2002 |
| JP | 10-103745 | 4/1988 |
| JP | 1-134764 | 5/1989 |
| JP | 7-1543 | 1/1995 |
| JP | 2003025791 | 1/2003 |
| WO | 2004/055750 A1 | 7/2004 |

* cited by examiner

*Primary Examiner* — Robert J Canfield
*Assistant Examiner* — Matthew J Smith
(74) *Attorney, Agent, or Firm* — Michael J. Striker

(57) ABSTRACT

The present invention relates to a fire alarm 1 that includes a base 1.5 and a fire alarm insert which can be connected to base 1.5. A covering cap 3 and a sheet 2, 2.1 located between the covering cap 3 and the fire alarm insert 1.1 are provided to cover fire alarm insert 1.1.

9 Claims, 1 Drawing Sheet

1
1.4
1.5
4
5
1.1
1.2
1.3
2
3

1
1.4
1.5
4
5
1.1
1.3
1.2
2.1
2
3.1
3

FIRE ALARM WITH A TRANSMITTER SPACED FROM A RECEIVER THROUGH A COLORED SHEET

CROSS-REFERENCE TO RELATED APPLICATION

The invention described and claimed hereinbelow is also described in German Patent Application DE 103 53 836.4 filed on Nov. 18, 2003. This German Patent Application, whose subject matter is incorporated here by reference, provides the basis for a claim of priority of invention under 35 U.S.C. 119(a)-(d).

BACKGROUND OF THE INVENTION

The present invention relates to a fire alarm. Fire alarms are used for the early detection of fire in fire-prone areas, to protect individuals and assets. Fire alarms are typically installed on ceilings and have a round, white housing with a diameter of approximately 10 cm and a height of approximately 7 cm to 10 cm. Due to its function, the housing rests against the ceiling. Fire alarms are industrial, series-production products, and fire alarms of the same type and that are made by the same manufacturer typically look the same. In public traffic areas, the fire alarm on the ceiling is typically recognized immediately as a fire alarm due to the size of its housing. The uniformity of series production and the housing shape are therefore always a compromise between the function of the fire alarm and the user's taste, and the aesthetics of the surroundings.

A light-scattering smoke detector is made known in DE 101 18 913 A1, which includes a light transmitter and a light receiver arranged such that a scattering point is located outside of the light-scattering smoke detector, in an open space, the light-scattering smoke detector including a cover for protecting the light transmitter and the light receiver, and means for distinguishing between smoke and other foreign objects located in a region around the scattering point. The means for distinguishing between smoke and other foreign objects includes a processor for analyzing the time profile of reception signals from the light receiver, it being possible to connect the processor to the light receiver. The technique applied by this light-scattering smoke detector for detecting fire makes it possible to install the light-scattering smoke detector essentially flush with the ceiling. As a result, an important step in terms of installing fire alarms of this type in a non-obtrusive manner has been accomplished. A fire alarm which is installed flush with the ceiling in this manner contrasts distinctly with the surroundings in terms of its color design, in particular when installed in colorful rooms, and is therefore still perceived as a conspicuous, distracting object. To feasibly adapt the color of the cover, which closes the fire alarm to the outside, by using a plastic which has been colored accordingly would result in an endless variety of different styles and the associated enormous logistical requirements. Despite a greater variety of color, an exact match with the color scheme at the installation site cannot be achieved with standardized series production methods. It should also be noted that the color scheme in the surroundings could be changed within the framework of renovation work. A fire alarm with a color that matched upon installation would then be perceived again as a distracting foreign object. The fire alarm cannot be subsequently painted to match the new surroundings, since, in the case of a fire alarm mounted flush against the ceiling without an optical labyrinth, there is a risk that painting it in a careless manner could negatively affect the responsiveness of the fire alarm.

Publication DE 101 18 913 A1 also makes known a light-scattering smoke detector which includes two light receivers or focusing optics for a light receiver for adjusting a defined measurement volume.

SUMMARY OF THE INVENTION

The fire alarm designed according to the present invention offers the advantage of universal usability, since it can be adapted to practically any type of surroundings in a simple, cost-effective manner. To this end, the fire alarm has a covering cap which is connectable with the housing of the fire alarm and closes the housing such that it is flush with the ceiling. The covering cap has a recess into which pre-stamped sheets can be inserted before the covering cap is placed on the housing of the fire alarm. Sheets of this type can be manufactured economically, in a large variety of color-fast shades. To ensure that the sheet is visible, the covering cap is preferably designed to be transparent. The fire alarm is preferably designed, as a series-production product, as an installation set that includes sheets in colors typically found in living spaces. The housing and covering cap are preferably connectable with each other via a detent or clip connection. In a further embodiment, a Velcro closure can also be provided. Detachable connecting means of this type provide a secure hold for the covering cap on the housing of the fire alarm. They also make it possible for the covering cap to be easily removed for replacement of a sheet and to be reconnected with the housing. To enable an optimal color match, even in challenging surroundings, the material and shape of the covering cap can help facilitate the color match. For example, a slightly convex shape of the covering cap can enhance the impression that shades of color transition in a visually-pleasing manner. In addition, the covering cap can also have a slight mat finish on all or at least part of its surface to further enhance this impression. As a result of the measures mentioned above, the differences between adjacent areas with different surface structures and colors blend. It is particularly rational to design the sheets to have different colors and/or different surface designs on either side. As a result, an even greater variety of color is provided in the accessories set. It is also possible, of course, to provide a replaceable sheet with a neutral color, which can be painted at the installation site, thereby enabling it to be adaptable exactly to the surroundings. Fire alarm inserts can also be used that do not cover the edge of the base when inserted in the base. In this case, the edge of the base itself can be covered with a faceplate. In this case as well, the faceplate can be designed such that it is easily removed for insertion of a sheet. Advantageously, the covering cap and/or faceplate can also be designed as templates to be used to cut covering material to fit. As a result, covering material that matches the surroundings can be cut to fit at the installation site and inserted in the covering cap instead of a sheet. In a further embodiment, a sheet with a contrast color that deviates significantly from the surroundings can also be used, of course, if this is desired for interior-design reasons. Special optical effects can be attained as a result. This high degree of flexibility is made possible by the means of attaining the object, according to the present invention.

BRIEF DESCRIPTION OF THE DRAWINGS

Exemplary embodiments of the present invention will be explained in greater detail below with reference to the drawing.

DESCRIPTION OF THE PREFERRED EMBODIMENT

Figure 1:
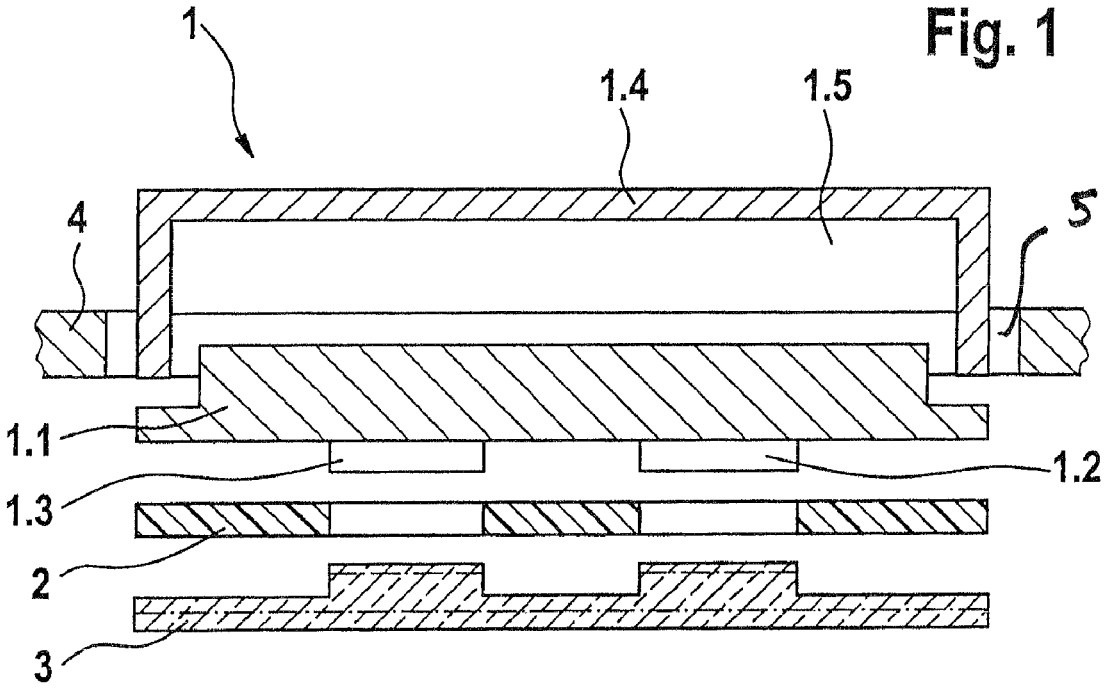
FIG. 1 Shows a first exemplary embodiment of a fire alarm which can be installed flush with the ceiling.

A first exemplary embodiment of the present invention is shown in FIG. 1. A fire alarm 1 is shown in a cross section. Fire alarm 1 includes a flush-mounted installation outlet 1.4 for installation of fire alarm 1 in a recess 5 of ceiling 4, into which a cable—which is not shown in the drawing—is inserted for connecting fire alarm 1. Fire alarm 1 also includes a base 1.5 which is connected with the interior of flush-mounted outlet 1.4 and on which the electrical wires of the cable are attached to contact elements. Fire alarm 1 also includes a fire alarm insert 1.1 which is inserted in base 1.5 with a detachable connection device and is thereby automatically connected with the contact elements. A radiation receiver 1.2 and a radiation transmitter 1.3 are located in fire alarm insert 1.1. Their ray paths enclose a scattering volume for the detection of conflagration gases. Fire alarm 1 also includes a preferably transparent covering cap 3 and a replacable sheet 2 located between covering cap 3 and fire alarm insert 1.1. In a normal installation procedure, flush-mounted outlet 1.4 and base 1.5 are preinstalled, independent of fire alarm insert 1.1 itself. At this point it does not matter at which point during installation when ceiling 4 is painted. When ceiling 4 is painted, it is usually necessary for fire alarm insert 1.1 to not be installed. Fire alarm insert 1.1 is typically installed in base 1.5 by technical personnel, who then checks it for proper functioning. Before inserting fire alarm insert 1.1 in base 1.5, the technical personnel selects a sheet 2 with a color that matches the color of ceiling 4, properly removes covering cap 3 of fire alarm insert 1.1 and inserts the selected sheet 2, which fits, since it was produced on an industrial scale. Covering cap 3 is subsequently reconnected with fire alarm insert 1.1. The technical personnel ensures that fire alarm 1 is not damaged when sheet 2 is inserted, and that it functions properly. The user can be consulted when selecting the proper sheet 2, so that the color selection conforms with conditions for use of the fire alarm system and the user's wishes. Unused sheets 2 can be stored with the documentation on the fire alarm system. If the color of ceiling 4 is changed when repainting is carried out, unused sheets 2 are still available, so that an appropriate color can be selected for fire alarm 1. When ceiling 4 is painted, fire alarm 1 must first be removed by the technical personnel, thereby ensuring that fire alarm 1 is handled properly even when sheet 2 is replaced.

Figure 2:
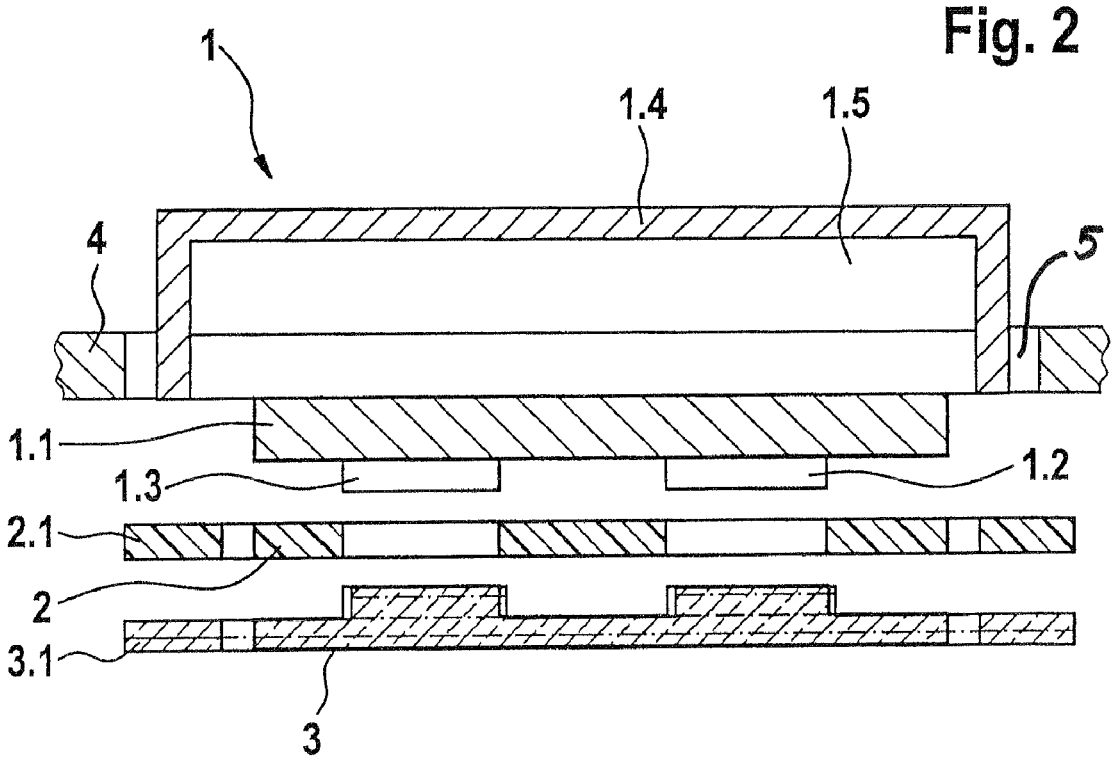
FIG. 2 Shows a second exemplary embodiment of a fire alarm.

A further exemplary embodiment of a fire alarm 1 is shown in a cross section in FIG. 2. A flush-mounted installation outlet 1.4 is also provided here, it being secured in a recess 5 of ceiling 4. A base 1.5 is located in flush-mounted installation outlet 1.4. A fire alarm insert 1.1 is detachably connected with base 1.4. With this exemplary embodiment of a fire alarm 1, fire alarm insert 1.1. secured in base 1.4 does not overlap the edge of base 1.4. To create a pleasing transition between fire alarm insert 1.1 and the adjacent surface of ceiling 4, an annular faceplate 3.1 is also provided, faceplate 3.1 enclosing covering cap 3. This faceplate is also advantageously designed such that it is easily removed, so that a sheet 3.1 can also be inserted in this annular edge region.

Despite the high level of flexibility in terms of adapting a fire alarm 1 to its surroundings that can be achieved with the means of attaining the object, according to the present invention, the color of ceiling 4 can not be matched with the color of sheets 2, 2.1 in every case, since the number of sheets 2, 2.1 is limited. By locating sheets 2, 2.1 between transparent covering cap 3 and fire alarm insert 1.1 and/or between faceplate 3.1 and the surface of ceiling 4, additional optical effects can also come into play, however. The reason for this is that the optical characteristics of covering cap 3 and faceplate 3.1 also play a role in the observer's perception of color. Due to the curvature of covering cap 3 and/or faceplate 3.1, and due to the material properties of covering cap 3 and faceplate 3.1, optical gradients result that compensate for the differences in the color nuances as perceived by the human eye. To this end, as shown in FIG. 2, covering cap 3 is preferably designed slightly convex in shape. This effect can be enhanced further by not designing the entire covering cap 3 and/or faceplate 3.1 to be transparent, but rather to provide it with a slight mat finish. In this case, fire alarm 1 looks like a slightly milky cover on the ceiling surface. Any other differences in color nuances that may still exist can no longer be distinguished.

Conversely, it is also possible to insert sheets 2 in fire alarm 1 with colors that contrast distinctly with the color of ceiling 4. This makes it possible for the user to "play" with colors and attain particular optical effects in terms of placement of the fire alarm.

It is also feasible to print different colors and/or patterns on either side of sheets 2, 2.1. As a result, with n sheets, the user has the possibility of selecting between 2n different colors.

It is also feasible to provide a replaceable neutral sheet 2, 2.1 with a suitable surface structure, which can be painted on-site in the ceiling color and that, after drying, is inserted in fire alarm 1. This also allows the color to be matched individually and exactly to the existing ceiling color.

What is claimed is:

1. A fire alarm (1) comprising a flush-mounted installation outlet (1.4) for installation in a ceiling, a base (1.5) connected with the flush-mounted installation outlet (1.4), a fire alarm insert (1.1) connected to the base (1.5) and carrying a radiation receiver (1.2) and a radiation transmitter (1.3) which are spaced from one another, a covering cap (3), and a sheet (2, 2.1) having a color substantially corresponding to a color of the ceiling, spaced from the base (1.5) and located between the covering cap (3) and the fire alarm insert (1.1) to cover the fire alarm insert (1.1), wherein the covering cap (3) has a recess into which the sheet (2, 2.1) is inserted, and wherein the covering cap (3) is transparent to expose the color of the sheet (2, 2.1), wherein the transmitter and the receiver provided on the insert (1.1) extend through the sheet (2, 2.1) to the transparent covering cap (3).

2. The fire alarm as recited in claim 1, wherein the covering cap (3) is convex in shape.

3. The fire alarm as recited in claim 1, wherein the covering cap (3) has a mat finish, at least in some areas.

4. The fire alarm as recited in claim 1, wherein the covering cap (3) is detachably connectable with the fire alarm insert (1.1) of the fire alarm (1).

5. The fire alarm as recited in claim 1, wherein the connecting means between the covering cap (3) and the fire alarm insert (1.1) are configured as releasable detent elements or as a Velcro closure.

6. The fire alarm as recited in claim 1, wherein the sheet (2, 2.1) is colored and/or has a pattern on it.

7. The fire alarm as recited in claim 1, wherein the sheet (2, 2.1) is colored on both sides and/or has a pattern on both sides, different colors and/or patterns being provided for each side of the sheet (2, 2.1).

8. The fire alarm as recited in claim 1, wherein the sheet (2, 2.1) is neutral in color and has a surface structure that can be painted in a common ceiling color.

9. The fire alarm as recited in claim 1, wherein said transmitter and said receiver are arranged on the insert such that a scattering point is located outside a light scattering smoke detector.

* * * * *